US012317997B2

(12) United States Patent
Carlson et al.

(10) Patent No.: US 12,317,997 B2
(45) Date of Patent: Jun. 3, 2025

(54) ADJUSTABLE SHELVING SYSTEMS AND METHODS

(71) Applicant: CleverMade, LLC, Carlsbad, CA (US)

(72) Inventors: Michael Herman Carlson, Encinitas, CA (US); Thomas Anthony Quinn, Carlsbad, CA (US); Jamison Burton Miller, San Marcos, CA (US); Geoff Alan, Toronto (CA); Lucas Campopiano, Copenhagen (DK); Will Hicks, Huntsville (CA); Alyia Tom, Tyndall (CA); William C. Wight, San Diego, CA (US); Jared L. Guttmann, San Marcos, CA (US)

(73) Assignee: CLEVERMADE, LLC, Carlsbad, CA (US)

( * ) Notice: Subject to any disclaimer, the term of this patent is extended or adjusted under 35 U.S.C. 154(b) by 144 days.

(21) Appl. No.: 17/985,493

(22) Filed: Nov. 11, 2022

(65) Prior Publication Data

US 2023/0200530 A1 Jun. 29, 2023

Related U.S. Application Data

(60) Provisional application No. 63/306,420, filed on Feb. 3, 2022, provisional application No. 63/263,997, filed on Nov. 12, 2021.

(51) Int. Cl.
*A47B 57/16* (2006.01)

(52) U.S. Cl.
CPC ..... *A47B 57/16* (2013.01)

(58) Field of Classification Search
CPC ..... A47B 57/16; A47B 57/265; A47B 57/00; A47B 57/06; A47B 57/08; A47B 57/26;
(Continued)

(56) References Cited

U.S. PATENT DOCUMENTS 3,472,476 A * 10/1969 Johnson ..... A47B 57/562 248/245
5,272,991 A * 12/1993 Carrigan, Jr. ..... A47B 96/067 211/188

(Continued)

FOREIGN PATENT DOCUMENTS

JP 5253042 * 10/1993
KR 20220136641 A * 11/2022

OTHER PUBLICATIONS

CleverMade. Quick-Adjust Shelving System. Vimeo video, <https://vimeo.com/417683905/6150801809>, Disclosed Jul. 2020. Representative screenshots taken at 5 seconds, 15 seconds, and 21 seconds. 4 pages.

(Continued)

*Primary Examiner* — Janet M Wilkens
(74) *Attorney, Agent, or Firm* — Perkins Coie LLP

(57) ABSTRACT

A shelving system has a plurality of support posts and one or more shelf assemblies, each shelf assembly having a height adjustment mechanism. A height adjustment mechanism can include a bracket attached to a shelf portion, wherein the bracket includes a channel for receiving a support post, and a latch element pivotably attached to the bracket. The latch element pivots between a first position in which the latch element engages an aperture in the support post to support the shelf assembly on the support post, and a second position in which the latch element is out of the aperture to allow the shelf assembly to move along the support post. The latch element can include a hook with a notch positionable to receive an edge of the aperture, and a side face positionable to rest or press against the support post.

20 Claims, 14 Drawing Sheets

(58) Field of Classification Search
CPC ..... A47B 57/40; A47B 57/42; A47B 57/10; A47B 57/545; A47B 57/404; A47B 96/024
USPC ..... 108/107, 109, 110, 147.15, 147.17, 108/147.11, 156, 180, 193, 146; 211/134, 211/187, 153, 192, 191; 248/326, 243, 248/248, 220.41
See application file for complete search history.

(56) References Cited

U.S. PATENT DOCUMENTS

| | | | | |
|---|---|---|---|---|
| 5,415,302 | A | 5/1995 | Carlson et al. | |
| 5,531,167 | A | 7/1996 | Stevens et al. | |
| 6,240,856 | B1 * | 6/2001 | Paskey | B25H 5/00 345/643 |
| 7,494,019 | B2 | 2/2009 | Kessell | |
| 8,042,477 | B2 * | 10/2011 | Lee | A47B 57/54 108/147.12 |
| 8,646,624 | B2 | 2/2014 | Fernandez | |
| D702,541 | S | 4/2014 | Mansor | |
| 10,299,588 | B1 | 5/2019 | Lai | |
| 10,827,833 | B2 * | 11/2020 | Romantic | A47B 57/545 |
| D942,561 | S | 2/2022 | Dunahay | |
| 11,415,159 | B2 | 8/2022 | Ronda | |
| D984,835 | S | 5/2023 | Hanlon | |
| D997,267 | S | 8/2023 | Dunahay | |
| D997,696 | S | 9/2023 | Yang | |
| D1,008,381 | S | 12/2023 | Dunahay | |
| D1,008,382 | S | 12/2023 | Dunahay | |
| 2004/0155160 | A1 | 8/2004 | Welch et al. | |
| 2006/0042522 | A1 * | 3/2006 | Trubiano | A47B 57/10 108/110 |
| 2008/0203040 | A1 | 8/2008 | Kologe | |
| 2009/0152225 | A1 | 6/2009 | Lee | |
| 2009/0184076 | A1 | 7/2009 | Lee | |
| 2009/0184078 | A1 * | 7/2009 | Lee | A47B 57/54 211/187 |
| 2014/0130837 | A1 | 5/2014 | Sy-Facunda | |
| 2017/0234344 | A1 | 8/2017 | Edman | |
| 2018/0066428 | A1 | 11/2018 | Diekroger | |
| 2018/0325257 | A1 | 11/2018 | Xiang | |
| 2019/0331288 | A1 | 10/2019 | Gupta | |
| 2022/0049518 | A1 | 2/2022 | Pruitt | |
| 2024/0287819 | A1 | 7/2024 | Peters et al. | |

OTHER PUBLICATIONS

CleverMade. Quick-Adjust Shelving System. Disclosed May 26, 2020. 6 pages.

Quick Adjust Shelving System by CleverMade. Vimeo video, <https://vimeo.com/435192044/bfb209e51a>, Disclosed Jul. 2020. Screenshots taken at 5 seconds, 18 seconds, and 21 seconds. 4 pages.

U.S. Appl. No. 29/825,672 for Carlson et al., filed Feb. 3, 2022.

International Search Report and Written Opinion mailed Feb. 14, 2023 in International Patent Application No. PCT/US22/49725, 17 pages.

International Preliminary Report on Patentability mailed May 23, 2024 in International Patent Application No. PCT/US22/49725, 9 pages.

* cited by examiner

ADJUSTABLE SHELVING SYSTEMS AND METHODS

CROSS-REFERENCE TO RELATED APPLICATIONS

The present application claims priority to U.S. Provisional Patent Application No. 63/306,420, filed Feb. 3, 2022, and to U.S. Provisional Patent Application No. 63/263,997, filed Nov. 12, 2021, each of which are incorporated herein by reference in its entirety.

TECHNICAL FIELD

The present disclosure is directed generally to shelving systems (such as adjustable shelving systems), and associated systems and methods.

BACKGROUND

Existing shelving systems (such as wire-frame shelving systems) conventionally include upright support posts that support wire-frame shelves. Adjusting the height of each wire-frame shelf can be difficult in conventional systems. For example, some conventional wire-frame shelves include hollow cylinder elements at each corner that receive the upright support posts. A user can place a sleeve (such as a plastic sleeve) inside the hollow cylinder element and around a support post to provide a friction lock between the wire-frame shelf each upright support post. It is often difficult to position each shelf at a specific height, and it is also difficult to adjust the height of a shelf after it has been initially positioned. For example, a mallet or other impact device may be required to adjust a conventional wire-frame shelf system. Embodiments of the present technology are directed to addressing these challenges and other challenges.

BRIEF DESCRIPTION OF THE DRAWINGS

In the drawings, wherein the same reference number indicates the same element throughout the several views.

DETAILED DESCRIPTION

The present technology is directed to shelving systems (such as adjustable shelving systems), and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments. Accordingly, embodiments of the present technology may include additional elements or exclude some of the elements described below with reference to FIGS. 1-14B, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

A representative shelving system can include a plurality of support posts and one or more shelf assemblies. At least one of the support posts can include an aperture. At least one of the shelf assemblies can have a shelf portion and a height adjustment mechanism for selectively supporting the at least one shelf assembly on the at least one of the support posts. The height adjustment mechanism can be attached to, or attachable to, the shelf, such that the shelf is couplable to the support post via the height adjustment mechanism engaging the aperture. In some embodiments, the height adjustment mechanism includes a bracket attached to the shelf portion, wherein the bracket includes a channel for receiving the at least one of the support posts. The height adjustment mechanism can further include a latch element pivotably attached to the bracket, wherein the latch element is pivotable to move between a first position in which the latch element engages the aperture to support the at least one of the shelf assemblies on the at least one of the support posts, and a second position in which the latch element is out of the aperture to allow the at least one of the shelf assemblies to move along the support posts. In some embodiments, the latch element has a hook at least partly positionable in the aperture, the hook having a notch positionable to receive an edge of the aperture. The latch element can include a side face positionable to rest or press against the at least one of the support posts.

Figure 1:
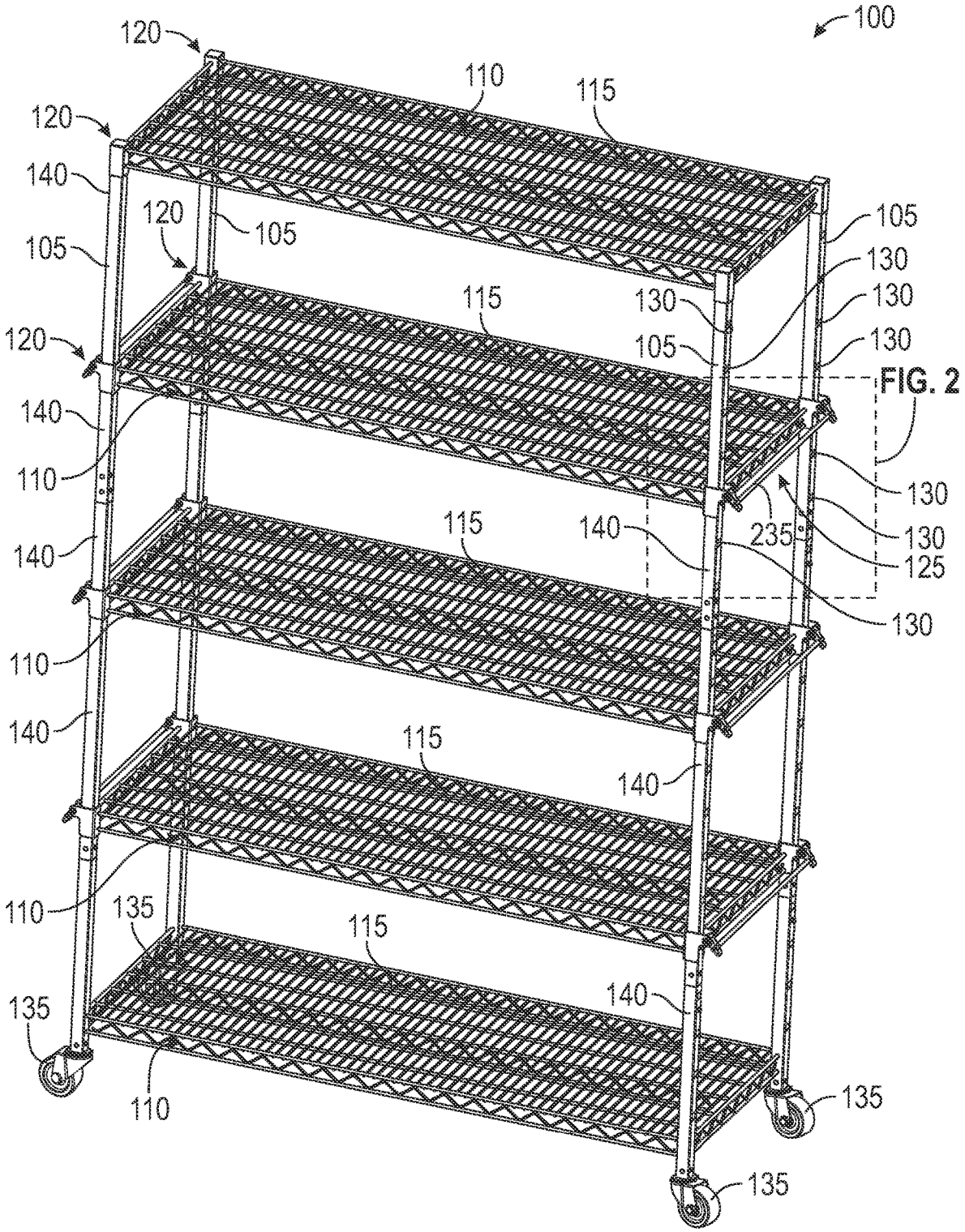
FIG. 1 illustrates a perspective view of a shelving system configured in accordance with embodiments of the present technology.

FIG. 1 illustrates a perspective view of a shelving system 100 configured in accordance with embodiments of the present technology. In some embodiments, the shelving system 100 can include a plurality of vertically elongated support posts 105 (e.g., four vertically elongated support posts 105) and one or more shelf assemblies 110 (e.g., two or more shelf assemblies 110) supportable on the support posts 105. Each of the shelf assemblies 110 can include a shelf portion 115 and one or more mounting portions 120 (e.g., a mounting portion 120 for each support post 105, such as four mounting portions 120) for supporting the shelf portion 115 on the support posts 105. In some embodiments, the shelf portions 115 can include at least a portion formed with a wire frame construction (e.g., as shown in FIG. 1) or another construction such as a solid planar surface formed with wood, plastic, metal, or another suitable construction for supporting items.

In some embodiments, one or more of the shelf assemblies 110 are selectively movable along the support posts 105 to adjust the height of the one or more shelf assemblies 110 and/or to adjust the spacing between adjacent shelf assemblies 110. In some embodiments, one or more (such as all) of the mounting portions 120 can be, or can include, a height adjustment mechanism 125 positioned to selectively limit and/or prevent movement of the respective shelf assembly 110 along the corresponding support posts 105. As explained in further detail below, in some embodiments, one or more of the support posts 105 (e.g., four of the support posts 105) can include one or more apertures 130 distributed along the length of the support posts 105. The height adjustment mechanism(s) 125 can engage the apertures 130 to selectively support the shelf assembly 110 at various selected levels or heights. In some embodiments, one or more of the support posts 105 (e.g., all of the support posts 105) can include two or more support post segments 140 that are connected together at respective ends thereof, as described in additional detail below.

In some embodiments, the shelving system 100 can include one or more base movement devices 135, such as casters, sliders, or other suitable movement devices, to assist with moving the shelving system 100. In other embodiments, base movement devices 135 can be omitted and the shelving system 100 can be freestanding and/or generally fixed in place.

Figure 2:
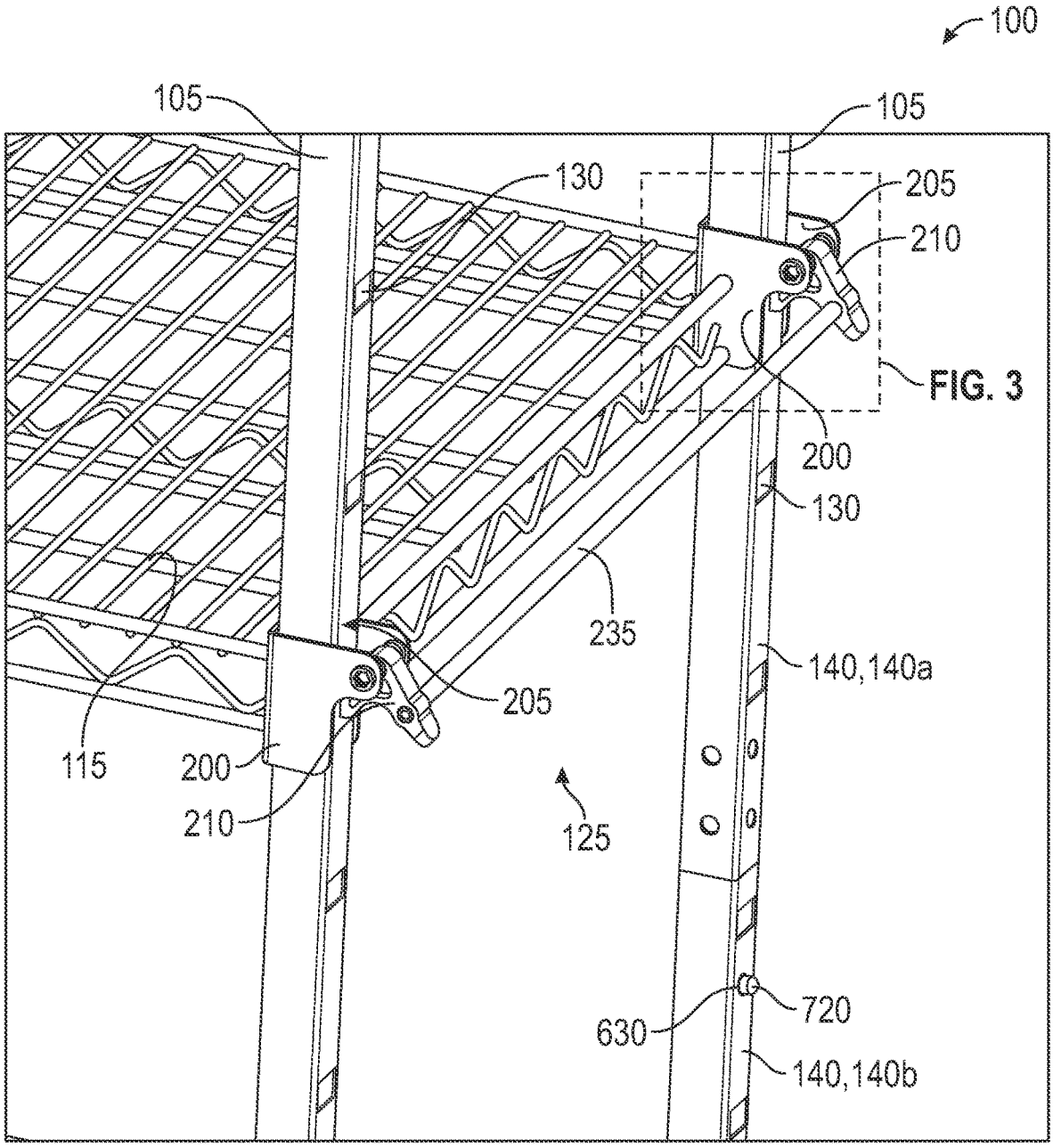
FIG. 2 illustrates a perspective detailed view of the portion of FIG. 1 identified as "FIG. 2" in FIG. 1.
Figure 3:
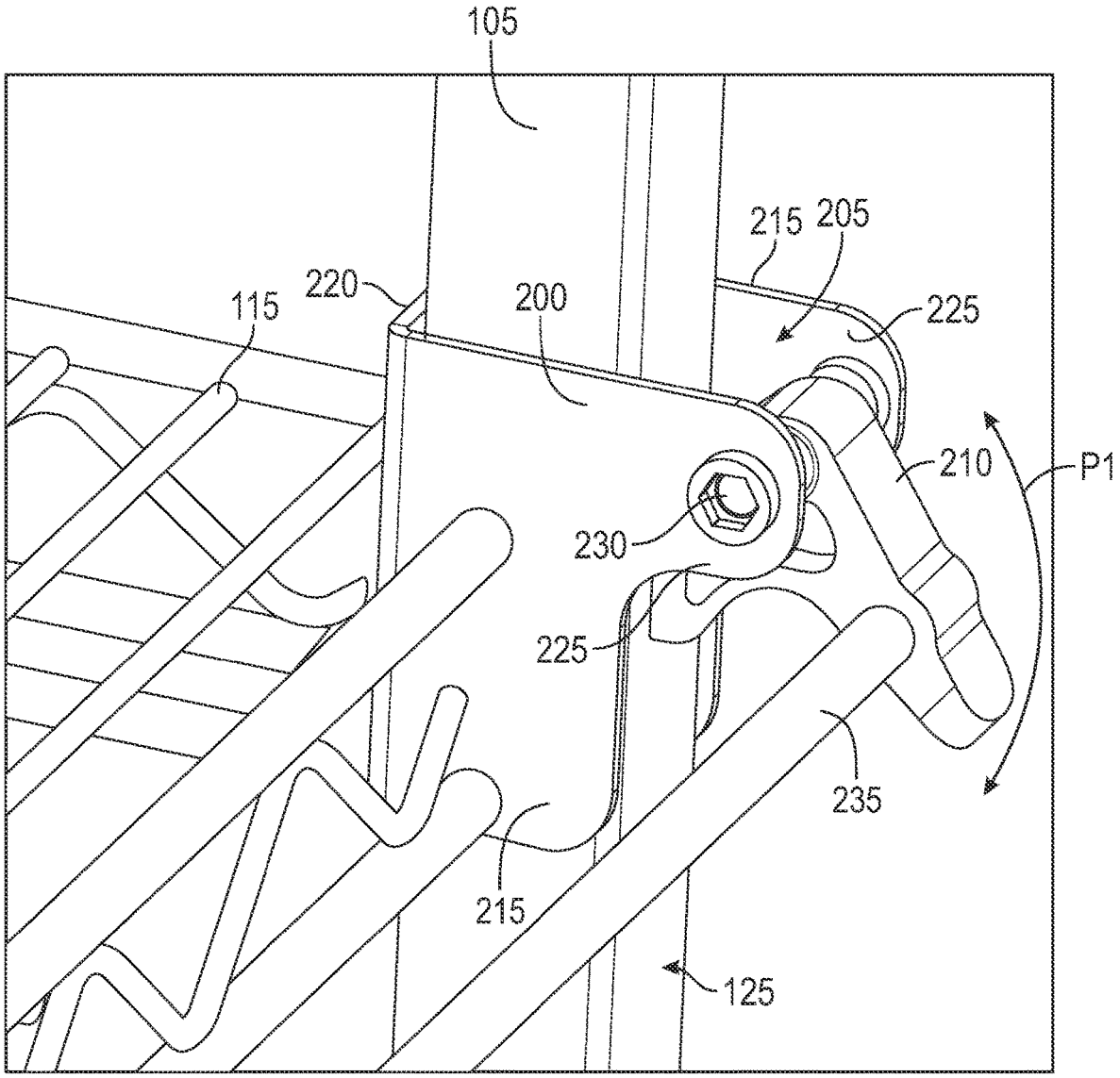
FIG. 3 illustrates a perspective detailed view of the portion of FIG. 2 identified as "FIG. 3" in FIG. 2.

FIG. 2 illustrates a perspective detailed view of the portion of FIG. 1 identified as "FIG. 2" in FIG. 1. FIG. 3 illustrates a perspective detailed view of the portion of FIG. 2 identified as "FIG. 3" in FIG. 2. With reference to FIGS. 2 and 3, in some embodiments, the height adjustment mechanism 125 can include one or more corner brackets 200 attached to the shelf portion 115 (e.g., by being welded onto the shelf portion 115, integral with the shelf portion 115, or otherwise suitably attached). In some embodiments, the corner brackets 200 can each include a channel 205 for receiving a corresponding support post 105. In some embodiments, the height adjustment mechanism 125 can further include a latch element 210 pivotably attached to each corner bracket 200. The latch element 210 can be at least partially positioned within the channel 205.

The latch element 210 is positioned to pivot along a pathway P1 between a first position in which the latch element 210 engages an aperture 130 (described in further detail below) to support the shelf assembly 110 on the support post(s) 105 (e.g., preventing the shelf assembly from moving downwardly), and a second position in which the latch element is out of the aperture 130 to allow the shelf assembly 110 to move along the support post(s) 105 (e.g., upwardly). Accordingly, in some embodiments, the latch element 210 can function like a ratchet or pawl relative to the apertures 130. In FIGS. 2 and 3, the latch elements 210 are shown in the first position (each engaged with an aperture 130, which is obscured by the corner brackets 200 in FIGS. 2 and 3).

With specific reference to FIG. 3, in some embodiments, the corner bracket 200 can be configured to only partially surround a perimeter of a corresponding support post 105. For example, in some embodiments, the channel 205 of the corner bracket 200 can be open. In some embodiments, the corner bracket 200 can be formed from a sheet of metal material bent to form the channel 205. For example, the corner bracket 200 can include a sheet of metal material bent to form an inward side 220 and opposing lateral sides 215 extending from the inward side 220. In some embodiments, the inward side 220 and the opposing lateral sides 215 can be separate elements fastened together (e.g., welded). Although the corner bracket 200 and the support posts 105 can include generally rectilinear shapes, as illustrated in FIGS. 1-3, other embodiments can include other suitable shapes or cross-sections.

In some embodiments, one or more of the opposing lateral sides 215 of the corner bracket 200 can include a lobe element 225 that can extend away from the inward side 220 of the corner bracket 200 and the support post 105, along the corresponding lateral side 215. The latch element 210 can be pivotably mounted to, and/or between, the opposing lateral sides 215 and/or the lobe or lobe elements 225. For example, the latch element 210 can be pivotably mounted to, and/or between, the lobe or lobes 215 via a suitable pin element 230 such as a bolt or a pin, or another suitable elongated element for pivotably mounting the latch element 210 between the lobe or lobes 215.

In some embodiments, each corner of a shelf assembly 110 can include a corner bracket 200 and a latch element 210. With continuing reference to FIGS. 2 and 3, in some embodiments, two latch elements 210 on a common side of the shelf assembly 110 can be connected via a connection element 235, such as a crossbar shown in FIGS. 1-3 spanning between the latch elements 210. The connection element 235 can facilitate simultaneous movement of the latch elements 210, which can simplify operation for a user in some circumstances (e.g., a user can lift the connection element 235). Accordingly, a height adjustment mechanism 125 can include two corner brackets 200 and two latch elements 210, i.e., a corner bracket 200 and a latch element 210 for each of two corners associated with a side of the shelving system 100.

With specific reference to FIG. 2, in some embodiments, one or more (such as each) support post 105 can include two or more post segments 140 connected together. For example, a first post segment 140*a* can be connected to a second post segment 140*b*, such as by stacking and fastening the two post segments 140*a*, 140*b* in a suitable manner. Additional description and illustration of suitable post segments 140 is below.

Figure 4A:
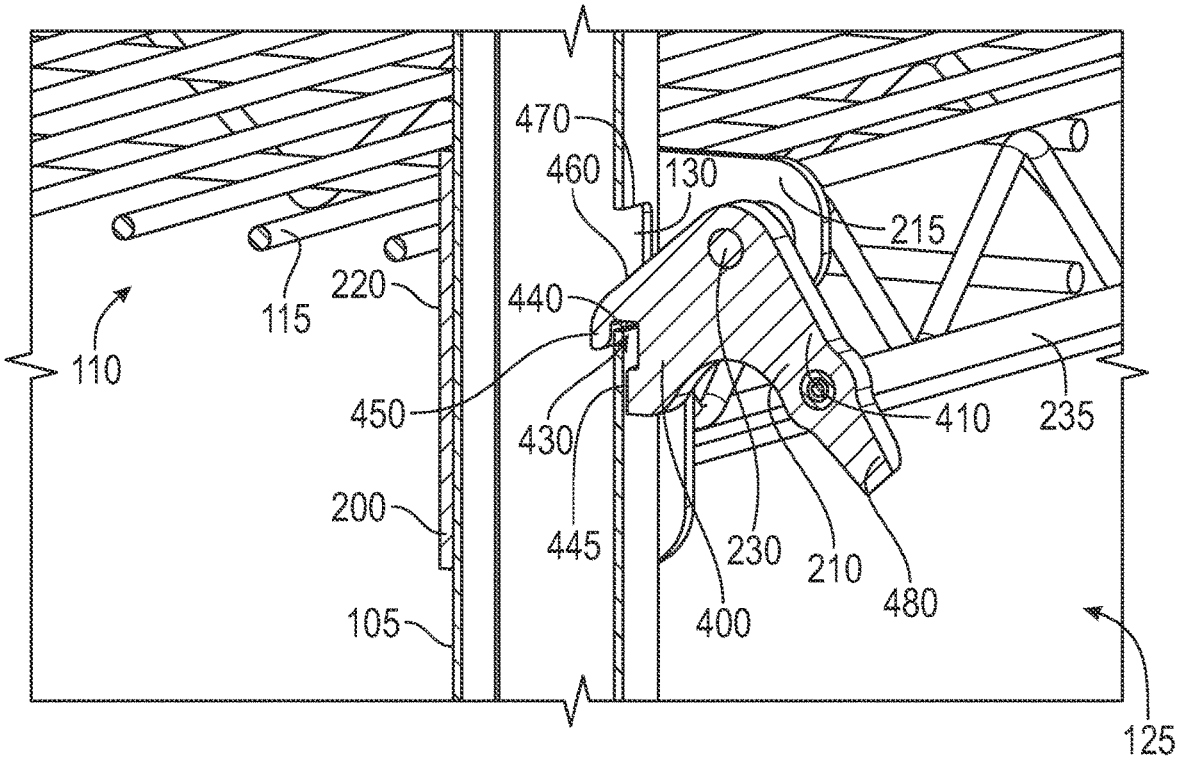
FIGS. 4A and 4B illustrate perspective schematic cross-sectional views of a portion of the shelving system shown in FIGS. 1-3.
Figure 4B:
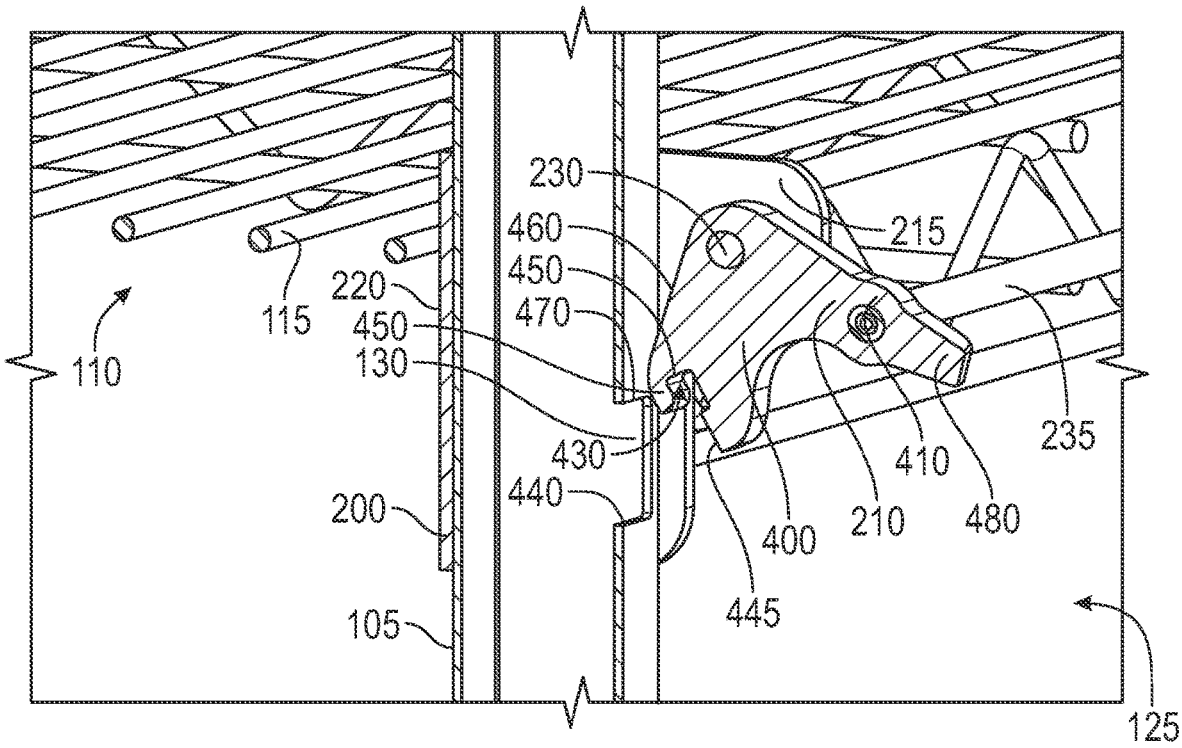

FIGS. 4A and 4B illustrate perspective schematic cross-sectional views of a portion of the shelving system 100 shown in FIGS. 1-3. FIG. 4A shows the latch element 210 engaged with the aperture 130. When the latch element 210 is engaged with the aperture 130, the latch element 210 and the aperture 130 prevent the shelf assembly 110 from moving downwardly. FIG. 4B shows the latch element 210 disengaged from the aperture 130. In FIG. 4B, a user has lifted upwardly on the shelf assembly 110, the latch element 210, and/or the connection element 235 to disengage the latch element 210 from the aperture 130 to raise the shelf assembly 110 (e.g., to another aperture 130, see FIG. 1).

With reference to both FIGS. 4A and 4B, in some embodiments, the latch element 210 can include a first pawl portion 400 and a second pawl portion 410 extending from, and oriented at an angle relative to, the first pawl portion 400. The pawl portions 400, 410 together can pivot about the pin element 230. In some embodiments, the latch element 210 can include a notch 430 positionable to receive an edge 440 of the aperture 130. The notch 430 can be in a hook portion 450 of the latch element 210, which can be part of the first pawl portion 400. In some embodiments, the latch element 210 can include a side face 445 that rests against the support post 105 when the notch 430 has received the edge 440. Accordingly, when the latch element 210 is engaged with the aperture 130, at least part of the hook portion 450 is in the aperture 130, and the side face 445 is pressed against the support post 105, both of which hold the shelf assembly 110 at the selected level.

In some embodiments, a top face 460 of the latch element 210 is positionable to engage another edge of the aperture 130, such as a top edge 470. When a user lifts the shelf assembly 110, the latch element 210 can move upwardly within the aperture 130 until the top face 460 of the latch element 210 contacts the top edge 470 of the aperture 130. As the user moves the shelf assembly 110 upwards, resistance from the top edge 470 against the top face 460 can cause the latch element 210 to pivot such that the hook portion 450 and the notch 430 come out of the aperture 130 to disengage the aperture 130 (see FIG. 4B). As the shelf assembly 110 raises, the hook portion 450 and the notch 430 can fall back into, or be pushed back into, another aperture 130. When upward force on the shelf assembly 110 is released, the notch 430 can engage a bottom edge 440 of the aperture 130 to be supported on the support post 105, and the side face 445 can again press against the support post 105. In some embodiments, the latch element 210 can include an extension portion 480 extending from the second pawl portion 410 (e.g., beyond the connection element 235) for grasping by a user. However, the extension portion 480 can be omitted in some embodiments.

Because the latch element 210 can pivot in and out of the apertures 130, the height adjustment mechanism 125 can function as a ratchet device, whereby the latch element 210 can be outside of an aperture 130 while the shelf assembly 110 is being raised (e.g., as in FIG. 4B), and it can be inside an aperture 130 to prevent the shelf from going back down (e.g., as in FIG. 4A). Accordingly, the height adjustment mechanism 125 is positionable to selectively prevent movement of a shelf assembly 110 along one or more of the support posts 105.

Figure 5:
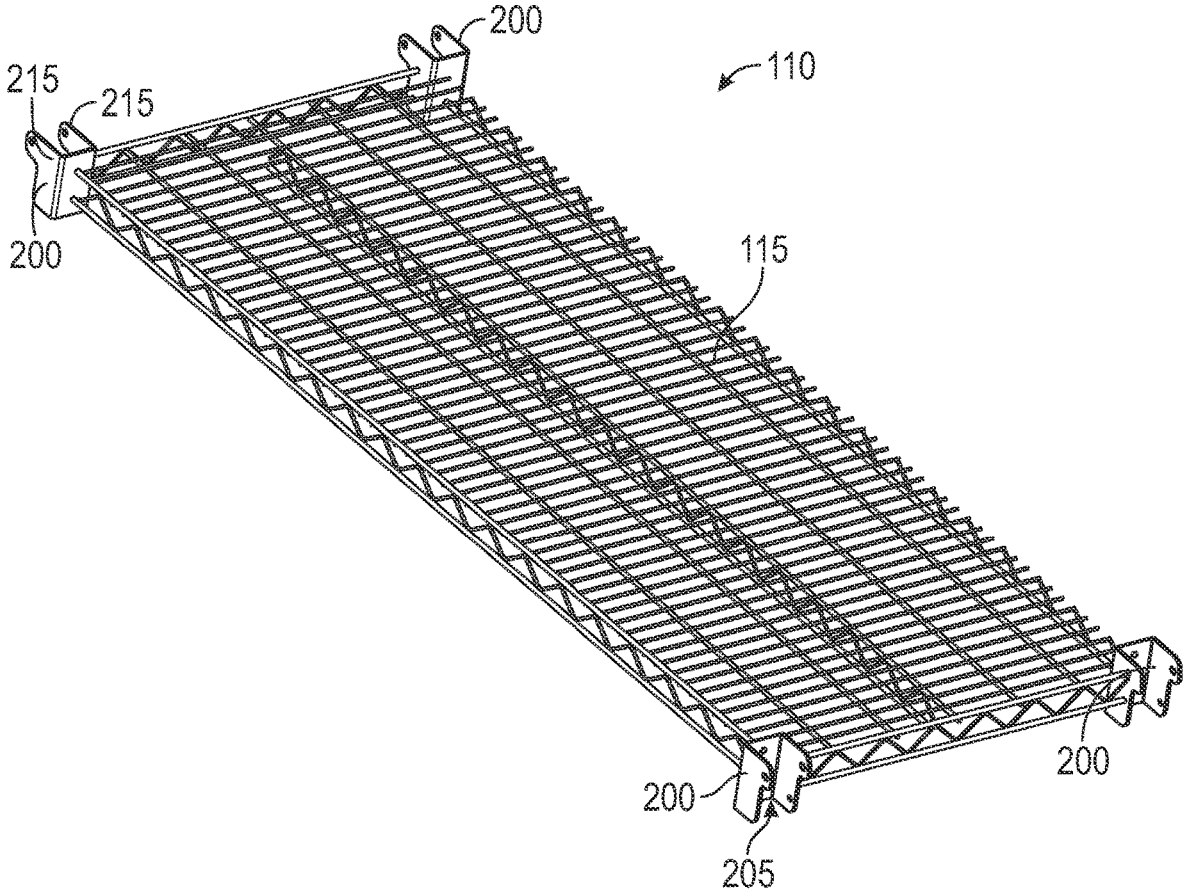
FIG. 5 illustrates a perspective view of a portion of a shelf assembly configured in accordance with embodiments of the present technology.

FIG. 5 illustrates a perspective view of a portion of the shelf assembly 110, in accordance with embodiments of the present technology. Specifically, FIG. 5 illustrates an example embodiment of the shelf portion 115 and the corner brackets 200 attached to, or integral with, the shelf portion 115.

Figure 6:
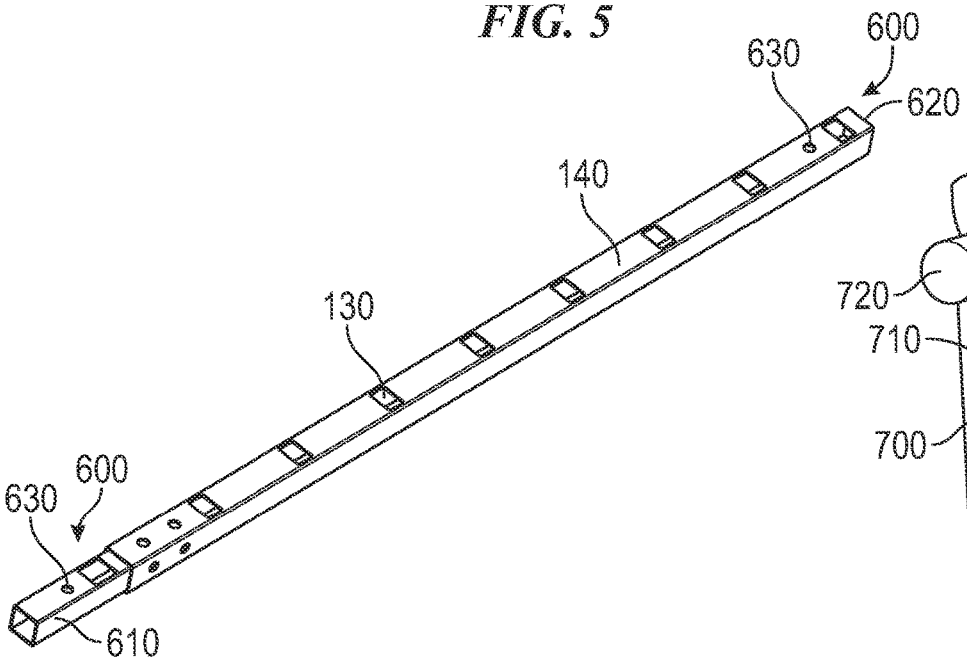
FIG. 6 illustrates a perspective view of a post segment configured in accordance with embodiments of the present technology.

FIG. 6 illustrates a perspective view of a post segment 140, configured in accordance with embodiments of the present technology. In some embodiments, each post segment 140 can include connection features 600 for connecting to other post segments 140 to form an overall support post 105. For example, the connection features 600 can include a protruding end 610 positioned and configured to mate with a socket end 620 on an adjacent post segment 140. Any suitable number of post segments 140 can form an overall support post 105. When two post segments 140 are connected via their respective protruding end 610 and socket end 620, locking holes 630 become aligned with one another, the relevance of which is described below with regard to FIG. 7.

Figure 7:
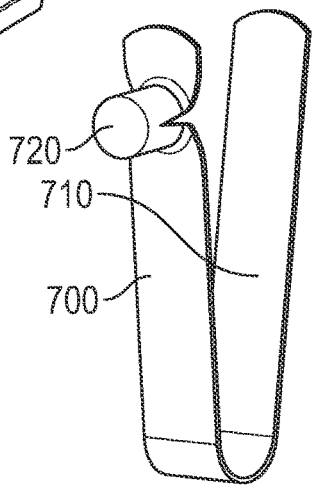
FIG. 7 illustrates a perspective view of a button clip configured in accordance with embodiments of the present technology, for affixing two adjacent post segments together.

FIG. 7 illustrates a perspective view of a clip element 700 configured in accordance with embodiments of the present technology for affixing two adjacent post segments 140 together. In some embodiments, the clip element 700 can include a spring element 710 (in the form of a resilient bent strip element, for example) that biases a button element 720 outwardly. When the locking holes 630 are in alignment (see FIGS. 2 and 6, for example), the button element 720 can project through the locking holes 630 to prevent the adjacent post segments 140 from coming apart unless the button element 720 is pressed back into the post segments 140 to no longer obstruct the locking holes 630. A user can insert the clip element 700 during assembly at a factory, or at another time such as during end-user assembly of the shelving system 100.

Figure 8A:
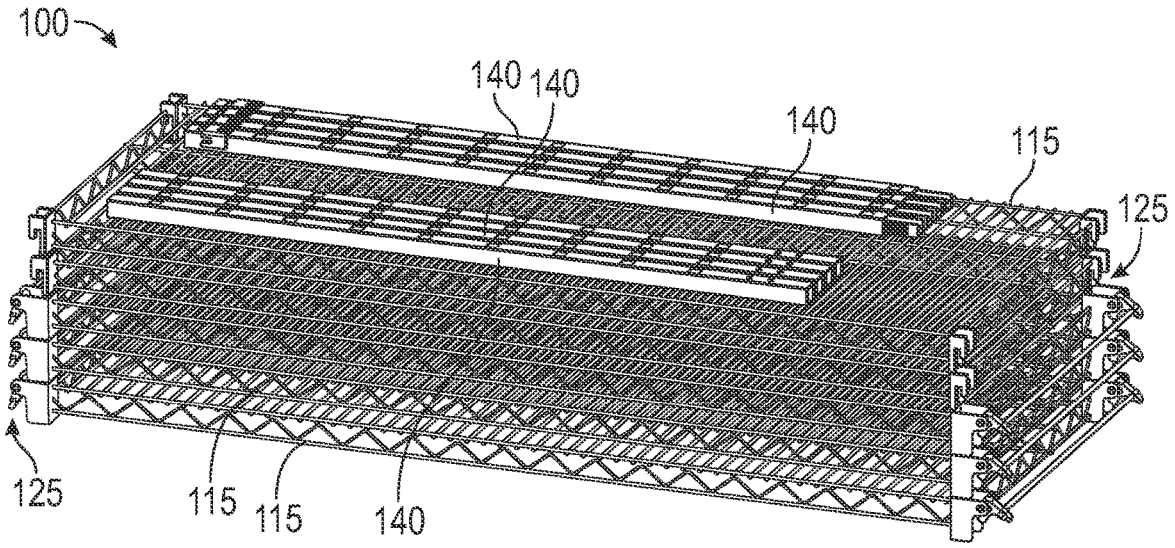
FIGS. 8A and 8B illustrate a perspective view and a front view, respectively, of the shelving system shown in FIG. 1, in a collapsed (stowed) configuration.
Figure 8B:
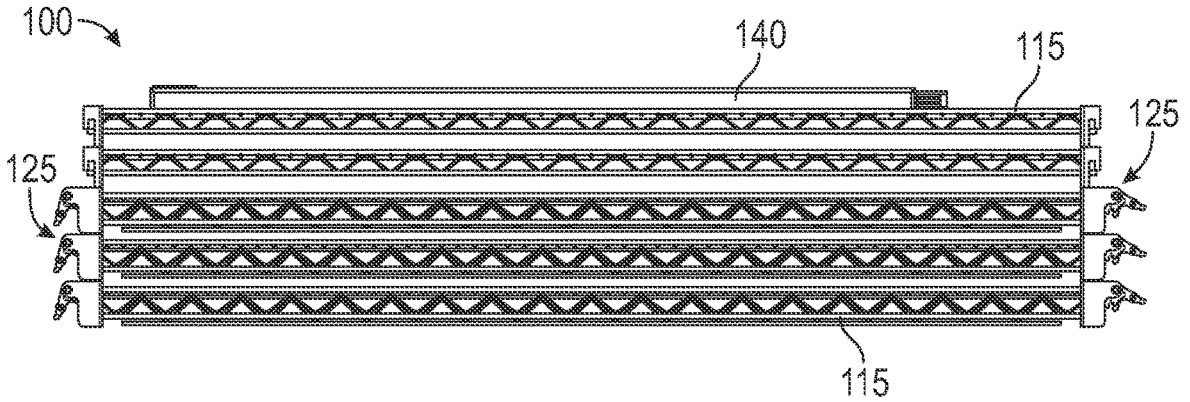

FIGS. 8A and 8B illustrate perspective views of the shelving system 100 in a collapsed (stowed) configuration (e.g., in a kit configuration, for shipment and/or storage). Optionally, although not shown, each of the shelves can be coupled to a set of lower post portions disposed at each corner of the shelves. The shelves can be stacked closely together. The support posts 105 and/or the post segments 140 can also be stacked in the collapsed shelving system 100. The system 100 can be deployed and/or assembled into the configuration shown in FIG. 1. Accordingly, the shelving system 100 can be configurable between a stowed configuration and a deployed configuration, such that when the shelving system is in the stowed configuration, two or more shelf assemblies are stacked closer together than when the shelving system is in the deployed configuration.

Figure 9:
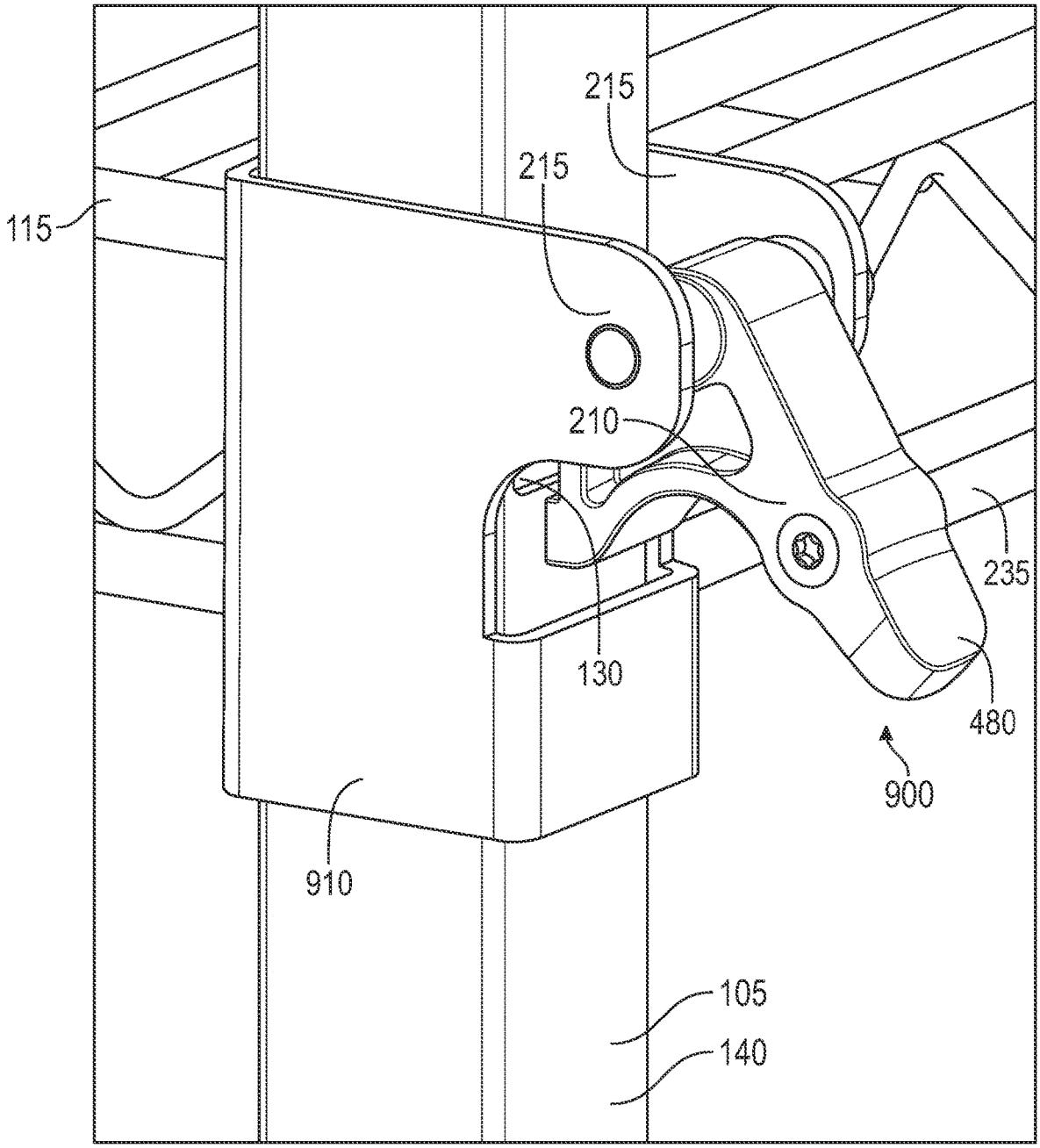
FIG. 9 illustrates a detailed perspective view of at least a portion of a height adjustment mechanism configured in accordance with further embodiments of the present technology.

FIG. 9 illustrates a detailed perspective view of at least a portion of a height adjustment mechanism 900, configured in accordance with further embodiments of the present technology. The perspective and components in FIG. 9 are generally similar to the perspective and components in FIG. 3. A corner bracket 910 can be generally similar to the corner bracket 200 described above with regard to FIG. 3, except that a channel 920 of the corner bracket 910 for receiving the post 105 fully girds the support post 105 (i.e. surrounds the entire perimeter of the support post 105), rather than being open. In some embodiments, the corner bracket 910 may be more stable than the corner bracket 200, while the corner bracket 200 may have less weight, although characteristics may vary depending on dimensions and materials.

Figure 10A:
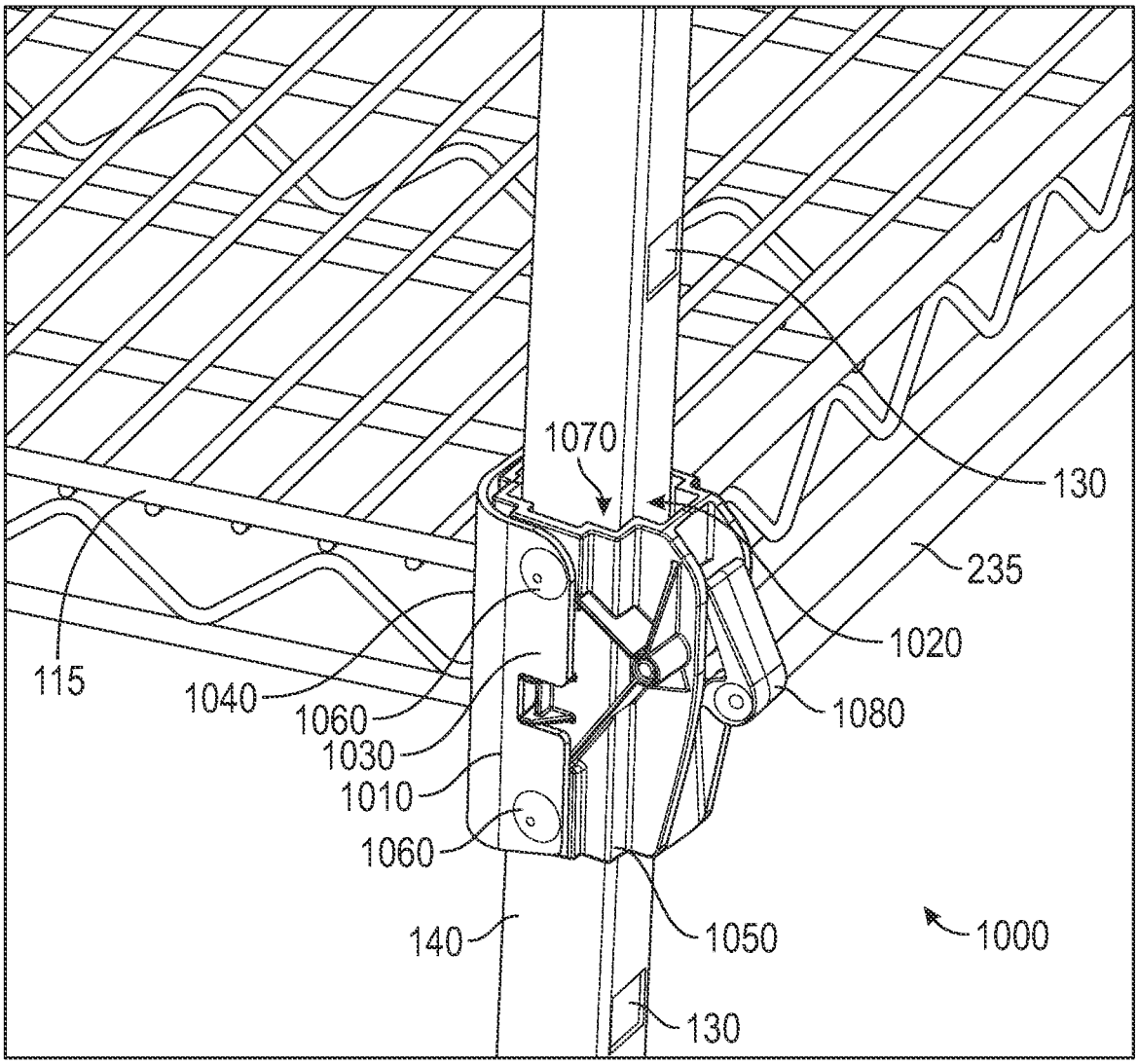
FIGS. 10A and 10B illustrate detailed perspective views from opposing sides, of a height adjustment mechanism configured in accordance with further embodiments of the present technology.
Figure 10B:
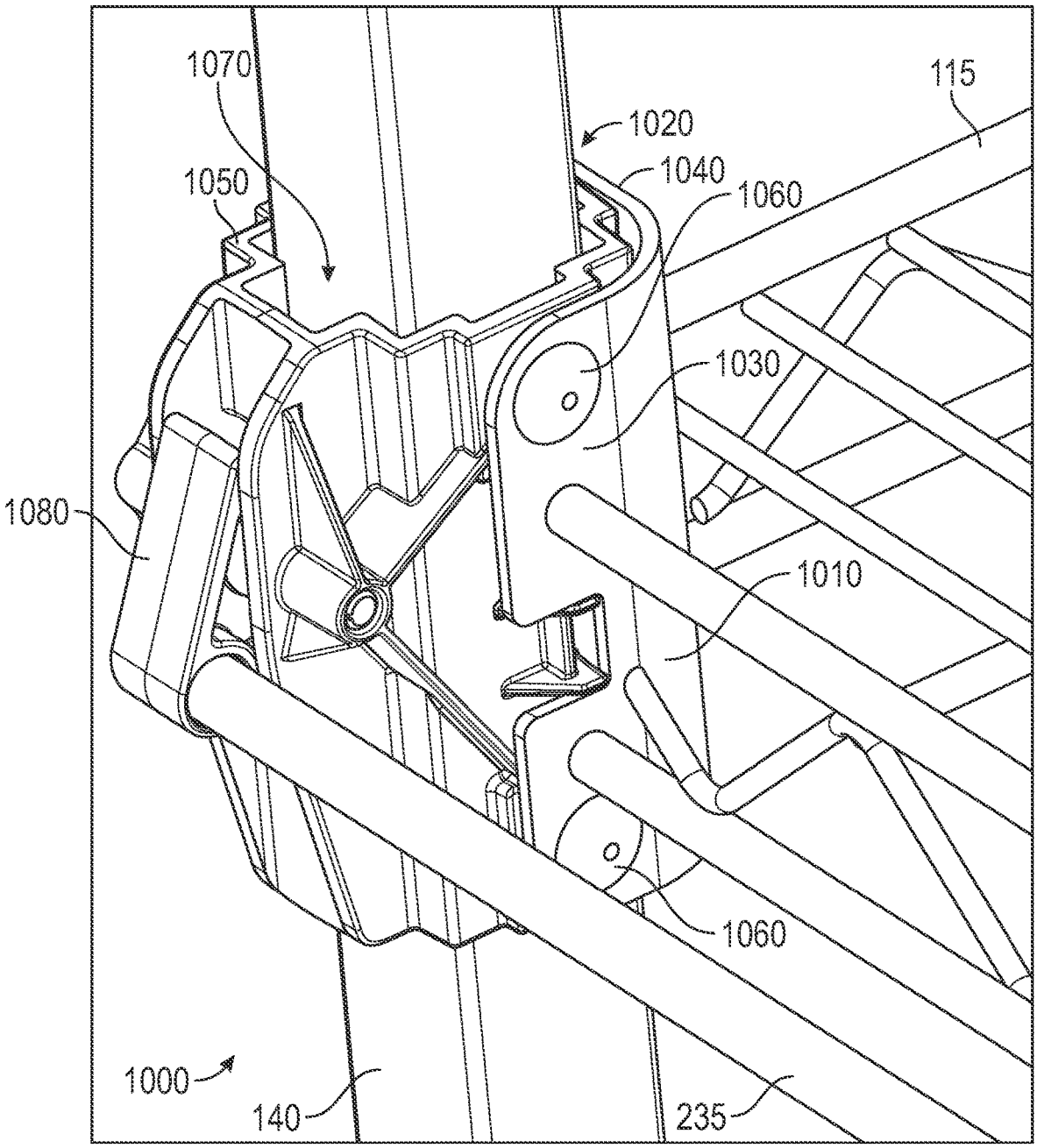
Figure 10C:
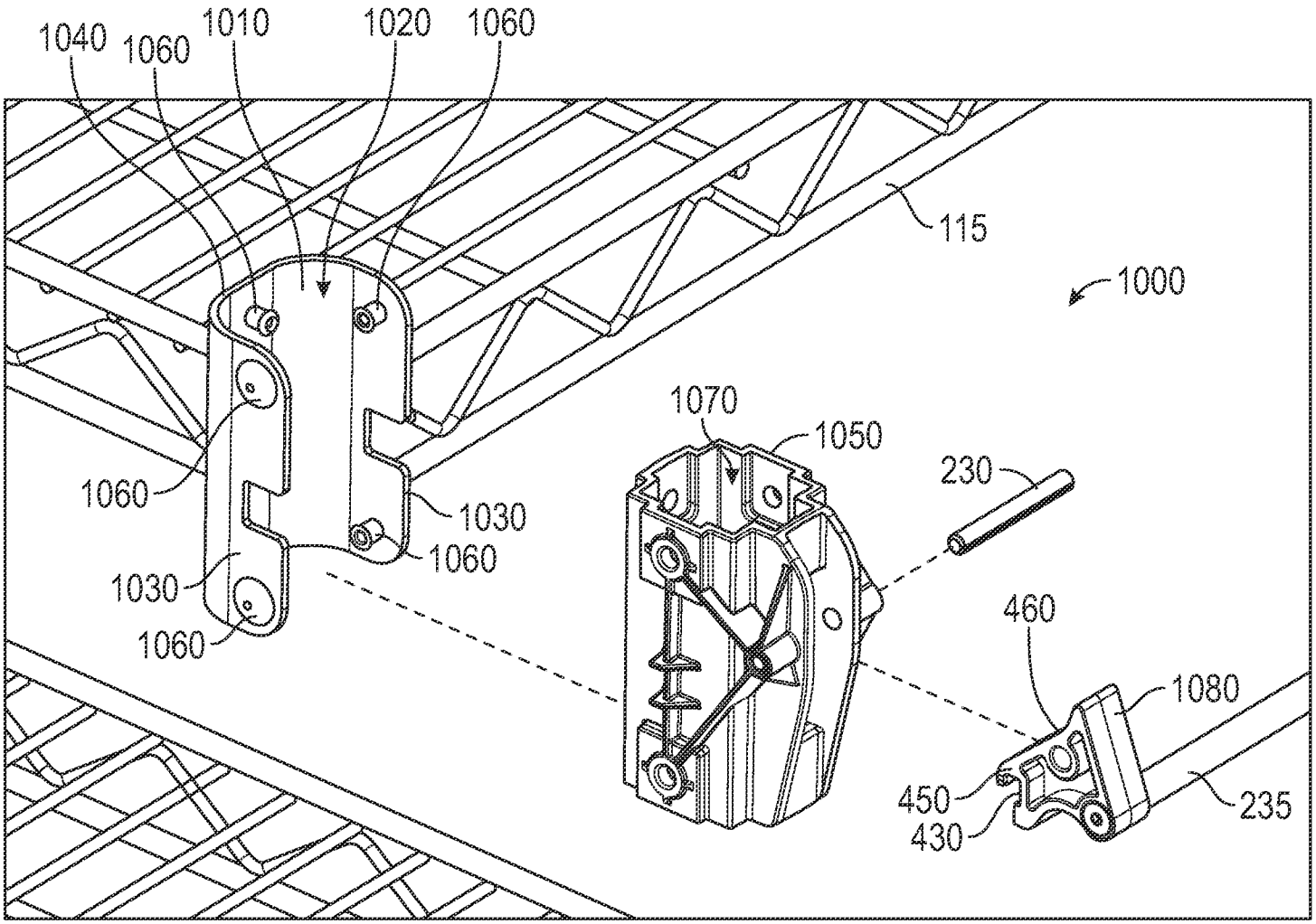
FIG. 10C illustrates an exploded perspective view of the height adjustment mechanism shown in FIGS. 10A and 10B.

FIGS. 10A and 10B illustrate detailed perspective views from different sides, of a height adjustment mechanism 1000 configured in accordance with embodiments of the present technology. FIG. 10C illustrates an exploded perspective view of the height adjustment mechanism shown in FIGS. 10A and 10B (the post segment 140 is not shown in FIG. 10C to avoid obscuring the illustration). The height adjustment mechanism 1000 can operate similarly to the height adjustment mechanisms 125, 900 described above with regard to FIGS. 1-9, and it can include some of the same or similar parts. In some embodiments, the height adjustment mechanism 1000 can include a corner bracket 1010 attached to the shelf portion 115. The corner bracket 1010 can include a channel 1020, which can be positioned between or adjacent to one or more lateral sides 1030 extending from an inward side 1040. The corner bracket 1010 can be formed by welding and/or bending sheet metal or by other suitable production methods and/or with other suitable materials. The height adjustment mechanism 1000 can further include a sleeve element 1050 that is positionable in the channel 1020. The height adjustment mechanisms described above with regard to FIGS. 1-9 can omit such a sleeve element 1050. In some embodiments, the sleeve element 1050 can be attached to the corner bracket 1010 with one or more fastener elements 1060, and/or with other suitable attachments. The sleeve element 1050 can include its own channel 1070 for receiving a post segment 140 and for facilitating movement of the sleeve element 1050 (and the remainder of the height adjustment mechanism 1000 and the shelf portion 115) along the post segment 140.

The height adjustment mechanism 1000 can further include a latch element 1080 that is similar to the latch element 210 described above, and which functions in a similar manner to pivot to engage and disengage an aperture 130. In some embodiments, the latch element 1080 can be the same as the latch element 210 described above, with the exception that in some embodiments, the extension portion 480 (see FIGS. 4A and 4B) can be omitted.

In some embodiments, the latch element 1080 can be pivotably mounted to the sleeve element 1050 (as opposed to being mounted to the corner bracket like in the embodiments described above with regard to FIGS. 1-9). In some embodiments, the sleeve element 1050 can be formed with a plastic material, or another suitable material.

Figure 11:
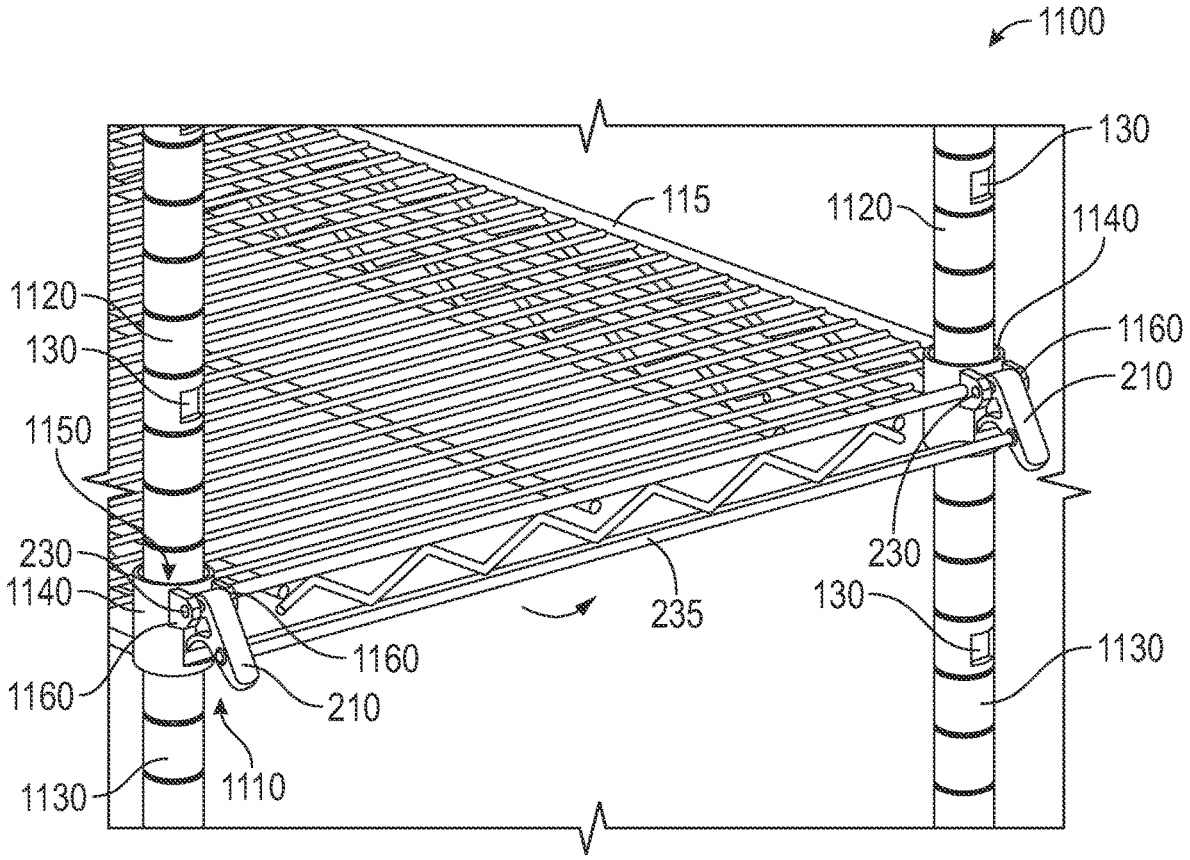
FIG. 11 illustrates a portion of a shelving system configured in accordance with further embodiments of the present technology.

FIG. 11 illustrates a portion of a shelving system 1100 configured in accordance with further embodiments of the present technology. The system 1100 can be generally similar to the shelving systems described above, and can include several similar components with similar functions. However, in some embodiments, a support post 1120 (and corresponding post segments 1130 forming the post 1120) can be round (e.g., circular) instead of having a rectilinear shape as with the systems above. Correspondingly, in some embodiments, each corner bracket 1140 can be round (e.g., circular) with a round (e.g., circular) channel 1150 therein for receiving the support post 1120. The round corner brackets 1140 can include one or more lobes 1160 for pivotably supporting the latch element 210 as it operates as explained above. Further embodiments can include other shapes of posts and brackets, such as ovals, triangles, or other suitable cross-sectional shapes.

Figure 12A:
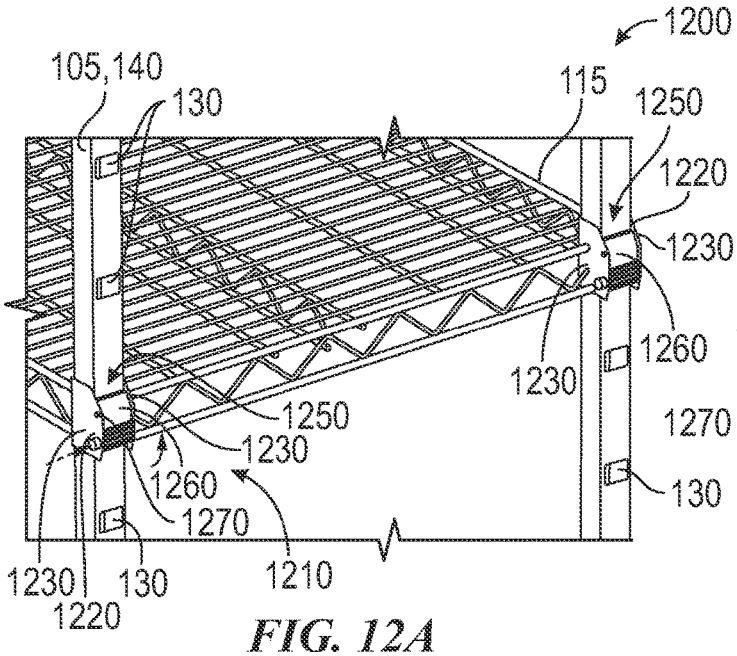
FIG. 12A illustrates a perspective view of a portion of a shelving system configured in accordance with further embodiments of the present technology.

FIG. 12A illustrates a perspective view of a portion of a shelving system 1200 configured in accordance with further embodiments of the present technology. The system 1200 can be generally similar to the shelving systems described above. The system 1200 can include a height adjustment mechanism 1210 that includes a corner bracket 1220 attached to each corner of the shelf portion 115. Each corner bracket 1220 can include one or more lateral sides 1230 extending from an inward side 1240. Each corner bracket 1220 can include a channel 1250 formed by, and between, the lateral sides 1230 and the inward side 1240. The channel 1250 is positioned to receive the support post 105 and/or a post segment 140 to facilitate movement of the shelf portion 115 up and down, as explained above with regard to other embodiments. The height adjustment mechanism 1210 can further include a latch element 1260 pivotably attached to the corner bracket 1220 (e.g., at the lateral sides 1230) via a pin element 1270 (which may be similar to the pin element 230 described above)) or another suitable pivot point. Each latch element 1260 is pivotable relative to its corresponding corner bracket 1220 to allow a tab or hook to enter or exit an aperture 130, as explained in further detail below. When the tab or hook is in the aperture 130, the tab supports the shelf assembly 1280 (which includes some or all of the height adjustment mechanism 1210 and the shelf portion 115).

Figure 12B:
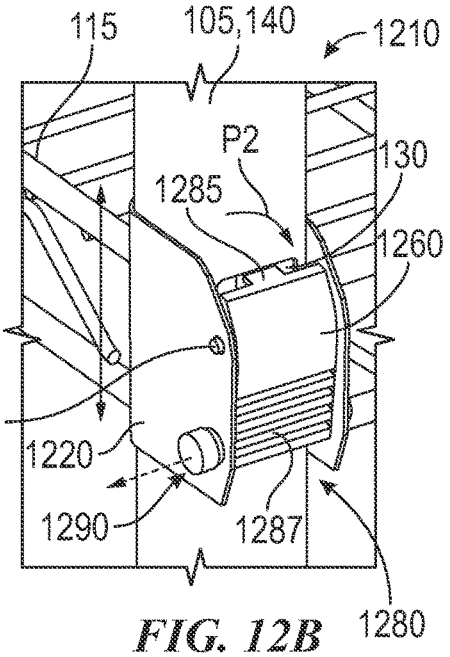
FIG. 12B illustrates a detailed perspective view of a portion of a height adjustment mechanism shown in FIG. 12A, in a first configuration in which the shelf assembly is supported on the support post.

FIG. 12B illustrates a detailed perspective view of a portion of the height adjustment mechanism 1210 shown in FIG. 12A, in a first configuration in which the shelf assembly 1280 is supported on the support post 105. The latch element 1260 can include a hook or tab 1285 that is positionable in the aperture 130, depending on the pivot position of the latch element 1260. In FIG. 12B, the tab 1285 is shown in the aperture 130, which will prevent the shelf assembly 1280 from traveling lower than the bottom of the aperture 130 will allow (i.e., the bottom edge 440, see FIGS. 4B and 12C). To release the tab 1285 so that the aperture 130 does not interfere with movement of the shelf assembly 1280 up or down, a user can push a user interface portion 1287 of the latch element 1260 opposite the tab 1285 to cause the latch element 1260 to pivot to pull the tab 1285 out of the aperture 130 and/or away from the support post 105, as indicated by the arrow P2. In some embodiments, the shelf assembly 1280 can include a biasing element that biases the latch element 1260 toward the first configuration (i.e., toward a position in which the tab 1285 is in the aperture 130). In some embodiments, the height adjustment mechanism 1210 can further include a locking mechanism 1290 for selectively preventing or allowing the latch element 1260 to pivot (i.e., for selectively preventing or allowing the latch element 1260 to move the tab 1285 out of the aperture 130).

Figure 12C:
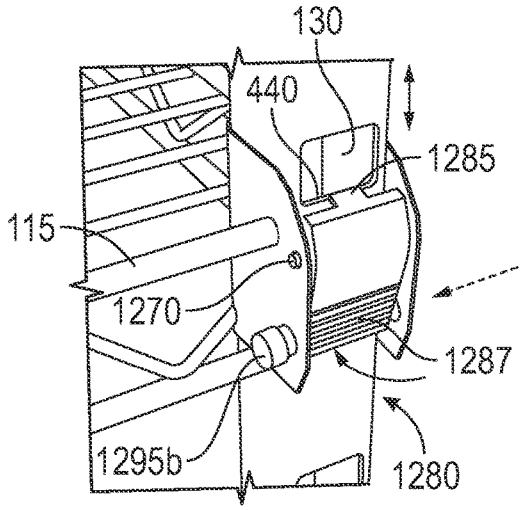
FIG. 12C illustrates a detailed perspective view of the portion of the height adjustment mechanism shown in FIG. 12B, in a second configuration in which the shelf assembly is generally freely movable along the support post.

FIG. 12C illustrates a detailed perspective view of the portion of the height adjustment mechanism 1210 shown in FIG. 12B, in a second configuration in which the shelf assembly 1280 is generally freely movable along the support post 105. In FIG. 12C, the latch element 1260 is pivoted about the pin element 1270 to pull the tab 1285 out of the aperture 130. For example, a user can apply pressure to the interface portion 1287 that is positioned opposite the pin element 1270 to cause the latch element 1260 to pivot and pull the tab 1285 out of the aperture 130. A user can move the shelf assembly 1280 up or down to the next aperture 130, which the tab 1285 can re-enter to hold the shelf assembly 1280 at the next level.

Figure 12D:
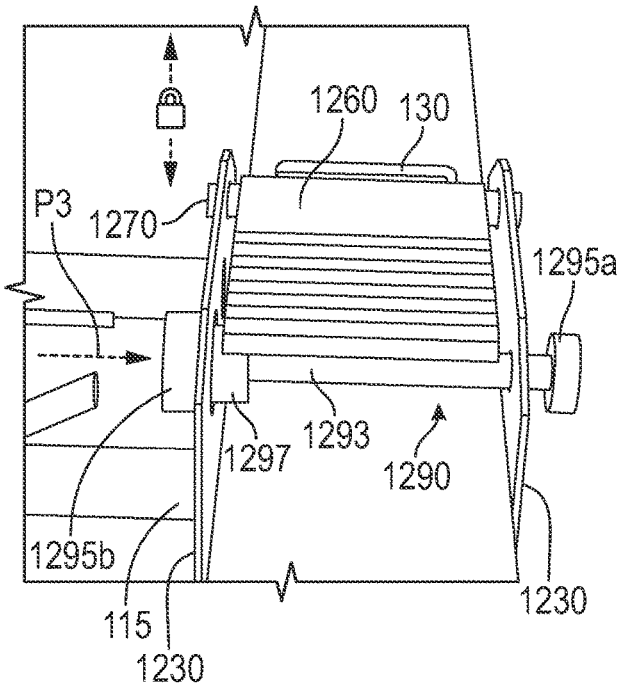
FIG. 12D illustrates a detailed perspective view of the portion of the height adjustment mechanism shown in FIG. 12B, in the first configuration in which a tab is in an aperture to support the shelf assembly on the support post, and in which a locking mechanism is engaged to prevent release of the tab.

FIG. 12D illustrates another detailed perspective view of the portion of the height adjustment mechanism 1210 shown in FIG. 12B, in the first configuration in which the tab 1285 is in the aperture 130. In some embodiments, the locking mechanism 1290 can include a shaft 1293 with knob elements 1295*a*, 1295*b* on either side. The knob elements 1295*a*, 1295*b* can be positioned outside of the lateral sides 1230, and the shaft 1293 can pass between the knob elements 1295*a*, 1295*b* and between the lateral sides 1230. The shaft 1293 can include a shoulder 1297 positioned toward one of the knob elements 1295*a*, 1295*b*. The shaft 1293 is movable back and forth along pathway P3 to selectively position the shoulder 1297 in or out of a position that obstructs the movement pathway of the latch element 1260. For example, in a first position (shown in FIG. 12D), the shoulder 1297 prevents the latch element 1260 from rotating, which prevents the tab 1285 from coming out of the aperture 130. In a second position (shown in FIG. 12C), the shoulder 1297 is clear of the rotational pathway of the latch element 1260 so that the latch element 1260 can rotate and pull the tab 1285 out of the aperture 130.

Figure 13A:
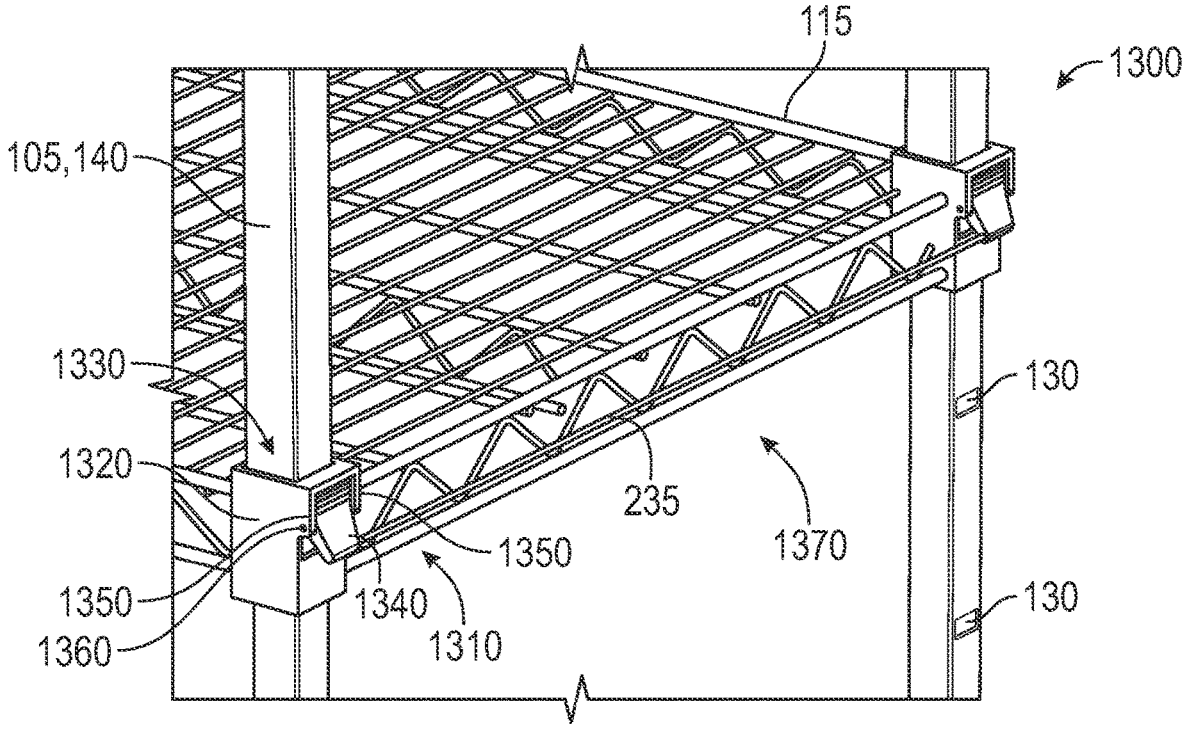
FIG. 13A illustrates a perspective view of a portion of a shelving system configured in accordance with further embodiments of the present technology.

FIG. 13A illustrates a perspective view of a portion of a shelving system 1300 configured in accordance with further embodiments of the present technology. The system 1300 can be generally similar to the shelving systems described above. The system 1300 can include a height adjustment mechanism 1310 that includes a corner bracket 1320 attached to each corner of the shelf portion 115. Each corner bracket 1320 can include a channel 1330 positioned to receive the support post 105 and/or a post segment 140 to facilitate movement of the shelf portion 115 up and down, as explained above with regard to other similar embodiments. The height adjustment mechanism 1310 can further include a latch element 1340 pivotably attached to the corner bracket 1320 (e.g., attached to one or more lobes 1350) via a pin element 1360 (which may be similar to the pin element 230 described above)) or another suitable pivot point. Each latch element 1340 is pivotable relative to its corresponding corner bracket 1320 to allow a hook or tab to enter or exit an aperture 130, as explained in further detail below. When the hook or tab is in the aperture 130, the tab supports the shelf assembly 1370. In some embodiments, two latch elements 1340 can be connected together via the connection element 235.

Figure 13B:
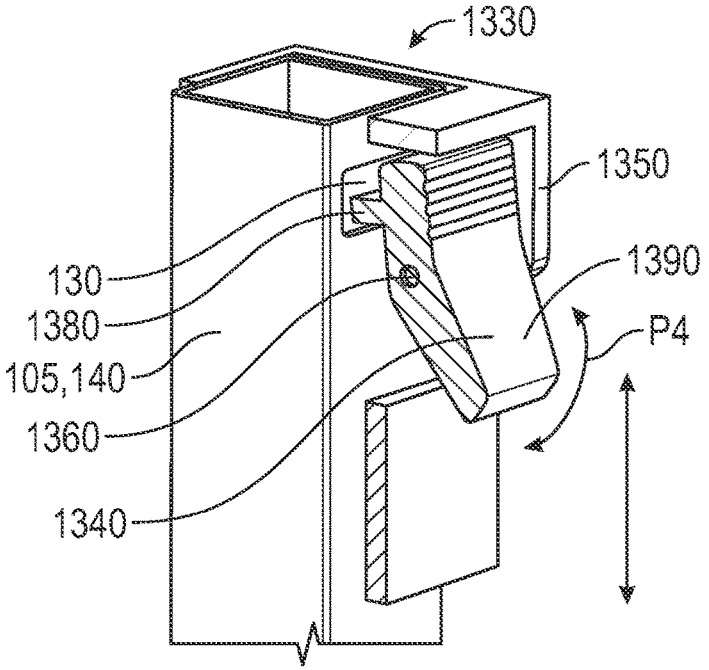
FIG. 13B illustrates a detailed cross-sectional perspective view of a corner bracket and a latch element shown in FIG. 13A.

FIG. 13B illustrates a detailed cross-sectional perspective view of the corner bracket 1320 and the latch element 1340 shown in FIG. 13A. The latch element 1340 can include the hook or tab 1380. When the tab 1380 is in the aperture 130, it prevents the shelf assembly 1370 from moving up or down beyond the width of the aperture 130. When the tab 1380 is out of the aperture 130, the corner bracket 1320 can move up or down freely relative to the support post 105. The latch element 1340 can include a user interface portion 1390 opposite from the tab 1380 from the pin element 1360 or other pivot point of the latch element 1340. Pushing on the user interface portion 1390 pivots the latch element 1340 to move the tab 1380 out of the aperture 130 (i.e., the latch element 1340 pivots along pathway P4).

Figure 14A:
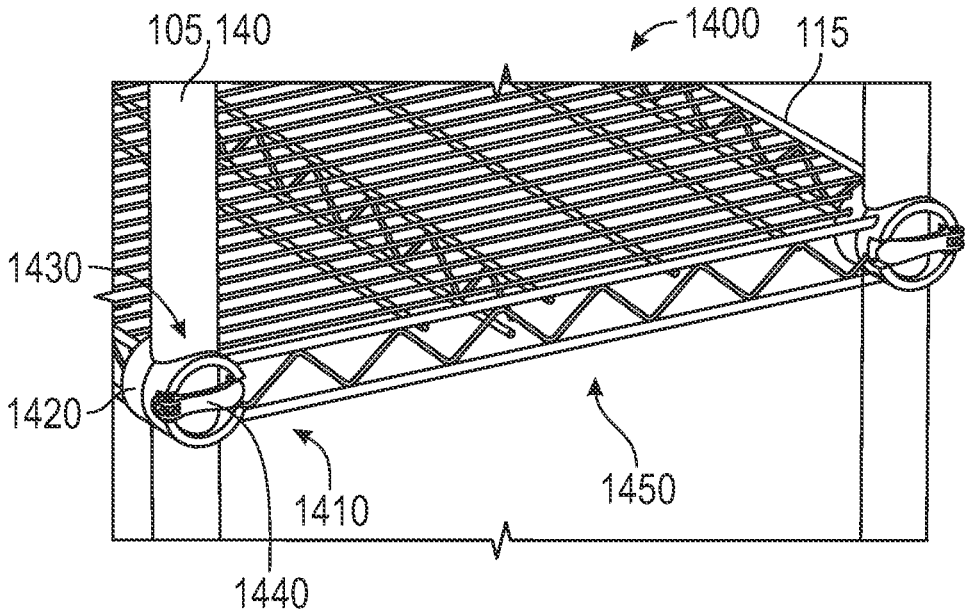
FIG. 14A illustrates a perspective view of a portion of a shelving system configured in accordance with further embodiments of the present technology.

FIG. 14A illustrates a perspective view of a portion of a shelving system 1400 configured in accordance with further embodiments of the present technology. The system 1400 can be generally similar to the shelving systems described above. The system 1400 can include a height adjustment mechanism 1410 that includes a corner bracket 1420 attached to each corner of the shelf portion 115. Each corner bracket 1420 can include a channel 1430 positioned to receive the support post 105 and/or a post segment 140 to facilitate movement of the shelf portion 115 up and down. However, instead of the height adjustment mechanism 1410 engaging apertures (which may be set at specific heights), the corner brackets 1420 include a friction clamp mechanism 1440 that frictionally engages the support post 105 at almost any desired height.

Figure 14B:
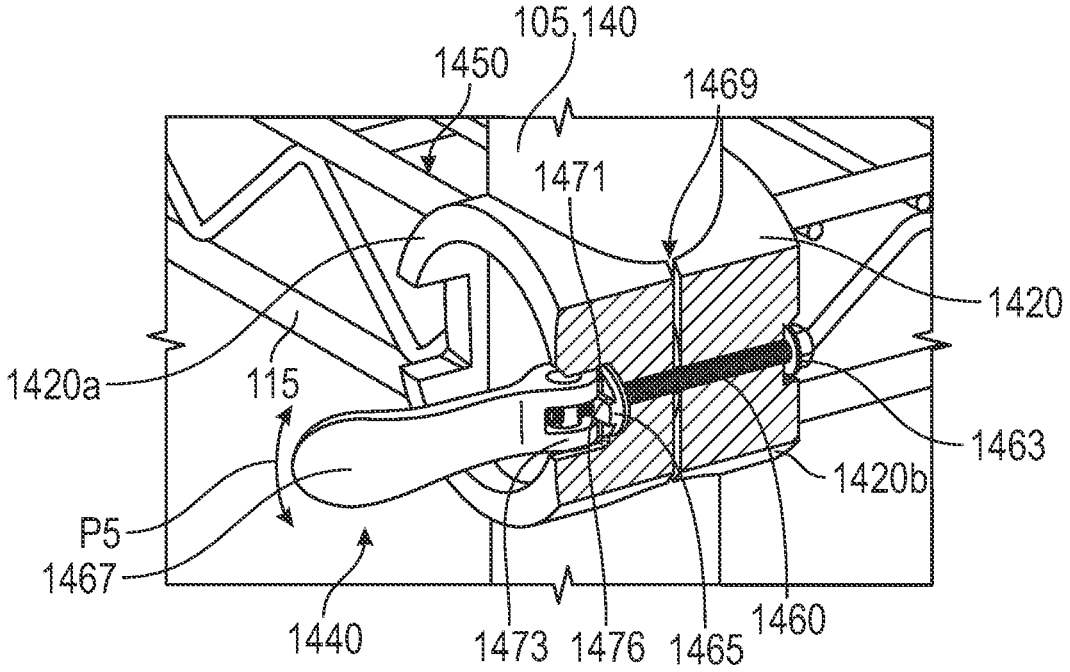
FIG. 14B illustrates a cross-sectional perspective detailed view of a friction clamp mechanism, configured in accordance with some embodiments of the present technology.

FIG. 14B illustrates a cross-sectional perspective detailed view of the friction clamp mechanism 1440. In some embodiments, the friction clamp mechanism 1440 can include portions of the corner bracket 1420. For example, the corner bracket 1420 can be bifurcated into two parts 1420*a*, 1420*b* that together generally surround the perimeter or diameter of the support post 105. Forcing the two parts 1420*a*, 1420*b* toward each other tightens the corner bracket 1420 around the support post 105, which increases friction and holds the shelf assembly 1450 in place. Conversely, releasing pressure between the two parts 1420*a*, 1420*b* reduces the friction and allows the shelf assembly 1450 to move up and down or otherwise along the support post 105.

In some embodiments, the friction clamp mechanism 1440 can include a tightening mechanism for forcing the two parts 1420*a*, 1420*b* together (and for releasing them to be able to move apart). In some embodiments, the tightening mechanism can include a rod element 1460 extending through the corner bracket parts 1420*a*, 1420*b*. A first end of the rod element 1460 can include a head portion 1463 to prevent it from pulling out of the corner bracket part 1420*b*. A second end of the rod element 1460 can include a connection element 1465. A lever element 1467 can engage the connection element 1465 to selectively pull the rod element 1460 to force the two parts 1420*a*, 1420*b* together, closing a gap 1469 therebetween and applying friction to the support post 105. In some embodiments, the lever element 1467 can include a first rail portion 1471 on an eccentric end 1473. The rail portion 1471 engages a corresponding rail portion 1476 on the connection element 1465. Rotation of the lever element 1467 along pathway P5 (toward and away from the shelf portion 115) causes the lever element 1467 to pivot about the eccentric end 1473 (i.e., about a pin or other fastener in the eccentric end 1473). As the eccentric end 1473 rotates, the first rail portion 1471 pulls the corresponding rail portion 1476 to tighten the friction clamp mechanism 1440. FIG. 14B shows the friction clamp mechanism 1440 in an open configuration in which the friction is reduced so the corner bracket 1420 can move along the support post 105. FIG. 14A shows the friction clamp mechanism 1440 in a closed configuration in which the friction is applied to the support post 105 to resist (e.g., prevent) movement of the corner bracket 1420 along the support post 105. In some embodiments, the rod element 1460, the head portion 1463, and/or the connection element 1465 can be threaded to adjust the amount of friction.

Some embodiments of the present technology include kits of parts for shelving systems. Kits of parts may include some or all of the elements of shelving systems described herein. For example, a kit of parts may include a plurality of support posts (which may include post segments that are attachable together), one or more shelves, one or more height adjustment mechanisms attached to, attachable to, or integral with the one or more shelves, and/or other components or combinations of components disclosed herein. A kit of parts may include post segments and shelf assemblies for shipping in a disassembled or stowed configuration.

From the foregoing, it will be appreciated that specific embodiments of the presently disclosed technology have been described herein for purposes of illustration, but that various modifications may be made without deviating from the scope of the technology. For example, in some embodiments, a spring element can be positioned in any of the height adjustment mechanisms with latches to bias the latches toward a position in which the latches engage the apertures. In some embodiments, the corner brackets may be separate elements that are attachable to the shelves as opposed to being built into or integral with the shelves.

Certain aspects of the technology described in the context of particular embodiments may be combined or eliminated in other embodiments. Further, while advantages associated with certain embodiments of the presently disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

Where the context permits, singular or plural terms may also include the plural or singular term, respectively. Unless otherwise specified, terms such as "attached" or "connected" are intended to include integral connections, as well as connections between physically separate components. As used herein, the term "and/or" when used in the phrase "A and/or B" means "A, or B, or both A and B." A similar manner of interpretation applies to the term "and/or" when used in a list of more than two terms. As used herein, the terms "generally" and "approximately" refer to values or characteristics within a range of ±10% from the stated value or characteristic, unless otherwise indicated. To the extent any materials incorporated herein by reference conflict with the present disclosure, the present disclosure controls.

What is claimed is:

1. A shelving system comprising:

a plurality of support posts, wherein at least one of the support posts comprises an aperture; and one or more shelf assemblies, wherein at least one of the one or more shelf assemblies comprises a shelf portion and a height adjustment mechanism for selectively supporting the at least one shelf assembly on the at least one of the support posts;

wherein the height adjustment mechanism comprises:

a corner bracket welded to the shelf portion or integral with the shelf portion, wherein the corner bracket comprises a channel for receiving the at least one of the support posts; and a latch element pivotably attached to the corner bracket, wherein the latch element comprises a hook at least partly positionable in the aperture, the hook having a notch positionable to receive an edge of the aperture, and wherein the latch element is pivotable to move between a first position in which the latch element engages the aperture to support the at least one of the shelf assemblies on the at least one of the support posts, and a second position in which the latch element is out of the aperture to allow the at least one of the shelf assemblies to move along the support posts.

2. The shelving system of claim 1, wherein, when the at least one of the support posts is in the channel, the corner bracket only partially surrounds a perimeter of the at least one of the support posts within the channel.

3. The shelving system of claim 1, wherein, when the at least one of the support posts is in the channel, the corner bracket is positionable to surround an entire perimeter of the at least one of the support posts within the channel.

4. The shelving system of claim 1, wherein the corner bracket comprises one or more lobe elements positionable to extend away from the at least one of the support posts, and wherein the latch element is pivotably attached to the one or more lobe elements.

5. The shelving system of claim 4, wherein the one or more lobe elements comprises two lobe elements, and wherein the latch element is supported between the two lobe elements.

6. The shelving system of claim 1, wherein the latch element comprises a side face positionable to rest or press against the at least one of the support posts.

7. The shelving system of claim 1, wherein the edge is a first edge, and wherein the latch element further comprises a face positionable to engage a second edge of the aperture, wherein engagement between the second edge and the face causes the hook to rotate out of the aperture.

8. The shelving system of claim 1, wherein the latch element comprises a first pawl portion and a second pawl portion, wherein the first pawl portion comprises the hook, and the second pawl portion extends from the first pawl portion.

9. The shelving system of claim 1, wherein the shelf portion comprises a wire frame.

10. The shelving system of claim 1, wherein the at least one of the support posts comprises two or more support post segments, wherein two support post segments of the two or more support post segments are connectable at respective ends thereof.

11. The shelving system of claim 10, wherein the two support post segments of the two or more support post segments are connectable via a button clip.

12. The shelving system of claim 1, wherein:

the corner bracket is a first corner bracket;

the latch element is a first latch element;

the at least one of the support posts is a first support post; and the shelving system further comprises:

a second support post of the plurality of support posts, wherein the second support post comprises a second aperture;

a second corner bracket attached to the shelf portion, the second corner bracket comprising a channel for receiving the second support post; and a second latch element pivotably attached to the second corner bracket, wherein the second latch element is pivotable to move between a first position in which the second latch element engages the second aperture to support the at least one of the shelf assemblies on the second support post, and a second position in which the second latch element is out of the second aperture to allow the at least one of the shelf assemblies to move along the support posts.

13. The shelving system of claim 12, wherein the first latch element is connected to the second latch element via a connection element.

14. The shelving system of claim 13, wherein the connection element is a crossbar spanning between the first latch element and the second latch element.

15. The shelving system of claim 1, wherein:

the one or more shelf assemblies comprises two or more shelf assemblies;

the shelving system is configurable between a stowed configuration and a deployed configuration; and when the shelving system is in the stowed configuration, the two or more shelf assemblies are stacked closer together than when the shelving system is in the deployed configuration.

16. A kit of parts for a shelving system, the kit comprising:

a plurality of support post segments, wherein at least one support post segment comprises an aperture;

a shelf; and a height adjustment mechanism, wherein the shelf is coupleable to the at least one support post segment via the height adjustment mechanism engaging the aperture;

wherein the height adjustment mechanism comprises:

a first bracket welded to the shelf or integral with the shelf;

a first latch element pivotably attached to the first bracket, wherein the first latch element comprises a hook or a tab for engaging the aperture;

a second bracket;

a second latch element pivotably attached to the second bracket; and a connection element connectable to the first latch element and the second latch element.

17. The kit of parts of claim 16, wherein the first latch element further comprises a side face positionable to rest or press against the at least one support post segment.

18. The kit of parts of claim 16, wherein the support post segments are connectable to form a support post.

19. A shelving system comprising:

a plurality of support posts, wherein at least one of the support posts comprises an aperture; and one or more shelf assemblies, wherein at least one of the one or more shelf assemblies comprises a shelf portion and a height adjustment mechanism for selectively supporting the at least one shelf assembly on the at least one of the support posts;

wherein the height adjustment mechanism comprises:

a corner bracket welded to the shelf portion or integral with the shelf portion, wherein the corner bracket comprises a channel for receiving the at least one of the support posts, wherein when the at least one of the support posts is in the channel, the corner bracket is positionable to surround an entire perimeter of the at least one of the support posts within the channel; and a latch element pivotably attached to the corner bracket, wherein the latch element is pivotable to move between a first position in which the latch element engages the aperture to support the at least one of the shelf assemblies on the at least one of the support posts, and a second position in which the latch element is out of the aperture to allow the at least one of the shelf assemblies to move along the support posts.

20. A shelving system comprising:

a plurality of support posts, wherein the plurality of support posts comprises a first support post and a second support post, the first support post comprises a first aperture, and the second support post comprises a second aperture; and one or more shelf assemblies, wherein at least one of the one or more shelf assemblies comprises a shelf portion and a height adjustment mechanism for selectively supporting the at least one shelf assembly on the first support post and the second support post;

wherein the height adjustment mechanism comprises:

a first corner bracket welded to the shelf portion or integral with the shelf portion, wherein the first corner bracket comprises a channel for receiving the first support post;

a first latch element pivotably attached to the first corner bracket, wherein the first latch element is pivotable to move between a first position in which the first latch element engages the first aperture to support the at least one of the shelf assemblies on the first support post, and a second position in which the first latch element is out of the first aperture to allow the at least one of the shelf assemblies to move along the first support post;

a second corner bracket attached to the shelf portion, the second corner bracket comprising a channel for receiving the second support post;

a second latch element pivotably attached to the second corner bracket, wherein the second latch element is pivotable to move between a first position in which the second latch element engages the second aperture to support the at least one of the shelf assemblies on the second support post, and a second position in which the second latch element is out of the second aperture to allow the at least one of the shelf assemblies to move along the second support post; and a connection element connecting the first latch element to the second latch element.

* * * * *